United States Patent [19]

Van Duyn

[11] Patent Number: 4,849,865

[45] Date of Patent: Jul. 18, 1989

[54] HEADLAMP VENTILATION SYSTEM

[75] Inventor: Paul D. Van Duyn, Anderson, Ind.

[73] Assignee: General Motors Corporation, Detroit, Mich.

[21] Appl. No.: 285,561

[22] Filed: Dec. 16, 1988

Related U.S. Application Data

[63] Continuation of Ser. No. 182,559, Apr. 18, 1988, abandoned.

[51] Int. Cl.[4] ..... F21V 29/00; F21V 7/20

[52] U.S. Cl. ..... 362/294; 362/61; 362/345; 362/373

[58] Field of Search ..... 362/61, 80, 96, 294, 362/345, 372

[56] References Cited

U.S. PATENT DOCUMENTS

| | | | |
|---|---|---|---|
| 4,249,232 | 2/1981 | Dick | 362/294 X |
| 4,569,007 | 2/1986 | Dick | 362/294 |
| 4,612,607 | 9/1986 | Segoshi et al. | 362/345 X |
| 4,635,173 | 1/1987 | Dressler et al. | 362/294 |
| 4,658,339 | 4/1987 | Tammeryin et al. | 362/294 |
| 4,747,032 | 5/1988 | Weber | 362/345 X |
| 4,796,163 | 1/1989 | Dressler | 362/80 X |

FOREIGN PATENT DOCUMENTS 3220704 3/1984 Fed. Rep. of Germany .

*Primary Examiner*—Ira S. Lazarus
*Assistant Examiner*—Peggy Neils
*Attorney, Agent, or Firm*—Edward J. Biskup

[57] ABSTRACT

A replaceable bulb headlamp of a rectangular configuration that includes an elongated passage along one side edge of the headlamp and a second elongated passage along the bottom edge of the headlamp, with each passage being located immediately behind and in line with the sealant channel for the lens and serving to communicate the interior of the headlamp with the atmosphere.

4 Claims, 2 Drawing Sheets

HEADLAMP VENTILATION SYSTEM

This is a continuation of application Ser. No. 07/182,559 filed on Apr. 18, 1988 now abandoned.

This invention concerns headlamps of the replaceable bulb type and more particularly relates to a ventilation system for such headlamps.

More specifically, the headlamp assembly according to the present invention includes a rectangular reflector member, the front face of which is closed by a rectangular lens member. The outer flange portion of the lens member is sealingly received within a channel formed around the entire margin of the front face of the reflector member. A first elongated recess is provided in the channel along one side edge of the reflector member and a second elongated recess is provided along the bottom edge of the reflector member. Each of the recesses is covered by a plate so as to form a passage and at the same time prevent the sealant for the lens to flow into the passage when the lens member is joined to the reflector member. In addition, port means are formed in the reflector member adjacent each of the recesses so as to allow the air to flow into the interior of the headlamp through one of the passages and out the other passage.

Two pages which may be considered pertinent to the ventilation system according to the present invention are Dick U.S. Pat. No. 4,249,232 and Dick 4,569,007. In FIG. 10 of the '232 patent, a headlamp unit is disclosed in which a spacer of elastically soft synthetic material has the front end accepting a glass lens while the rear end is attached to a reflector. A ventilation system is provided adjacent the reflector rim and has an opening at the top of the headlamp unit an an opening at the bottom of the headlamp so that air exchange can take place. The '007 patent is similar to the '232 patent in that it also concerns a headlamp unit in which the lens is connected to the reflector through a spacer. As with the '232 patent, vent means are located between the inner end of the spacer and the rim of the reflector. In neither the '232 patent nor the '007 patent, however, is a boss provided immediately adjacent the seal channel for the lens to form a passage for providing air circulation to the interior of the headlamp as provided by this invention.

The objects of the present invention are to provide a new and improved ventilating system for a replaceable bulb headlamp; to provide a new and improved ventilating system for a replaceable bulb headlamp of a rectangular configuration that includes an elongated passage along one side edge of the headlamp and an elongated passage along the bottom edge of the headlamp with each passage being located immediately behind and in line with the usual sealant channel for the lens and serving to communicate the interior of the headlamp with the atmosphere; to provide a new and improved ventilating system for a replaceable bulb headlamp of a rectangular configuration in which the sealant channel for the lens along the opposite side edge and along the bottom edge of the reflector member is formed with separate elongated recesses and each recess is covered with an L-shaped plate so as to form a passage which serves to communicate the interior of the headlamp with the atmosphere; and to provide a new and improved ventilating system for a replaceable bulb headlamp adjacent and to the rear of the sealant channel at spaced locations thereof for providing passageways for air to enter and flow out of the interior of the headlamp.

Other objects and advantages of the present invention will be apparent from the following detail description when taken with the drawings in which FIG. 1 is a front elevational view of a replaceable bulb headlamp with the lens broken away to more clearly show the ventilation system according to the present invention;

Figure 1:
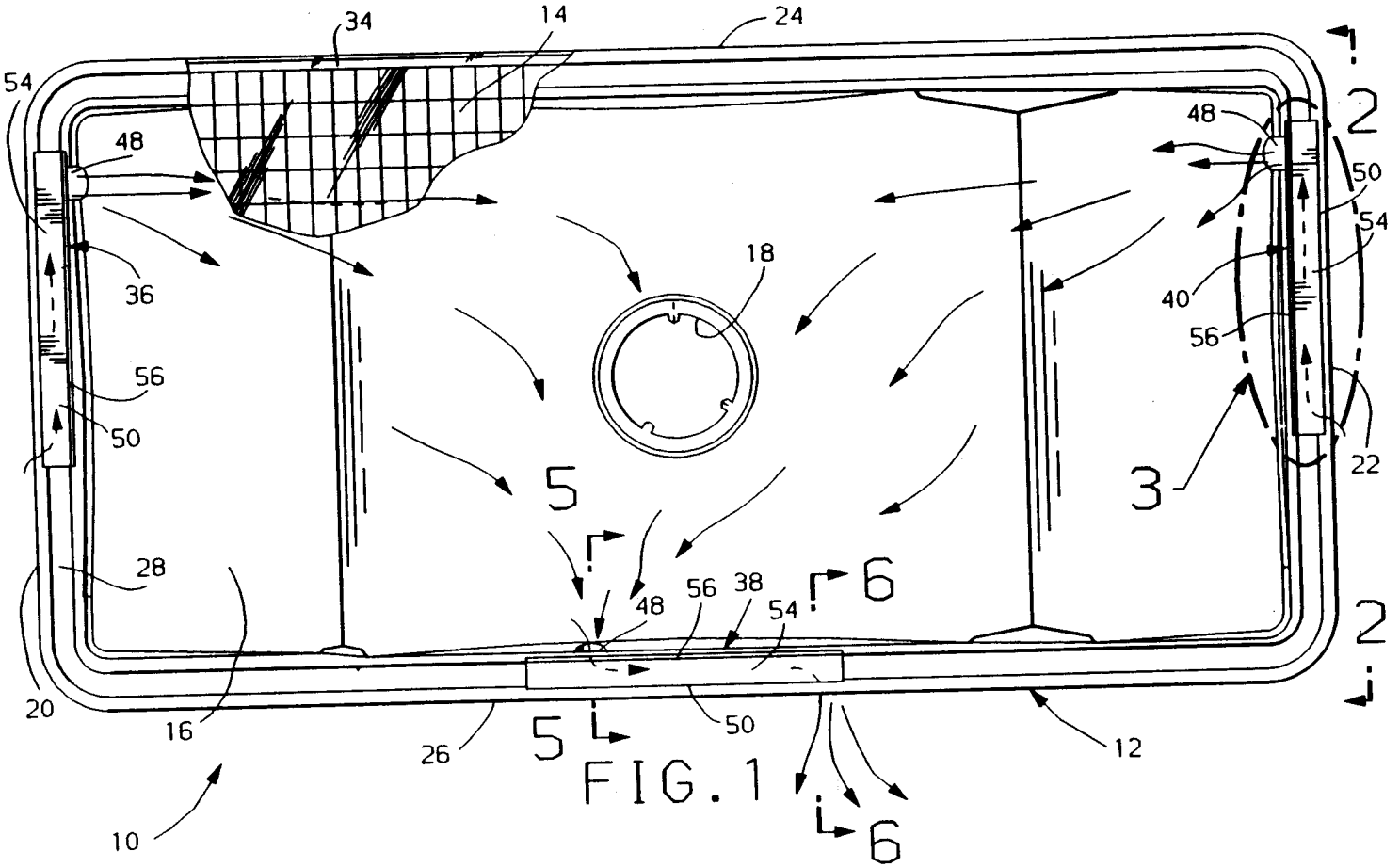
Figure 2:
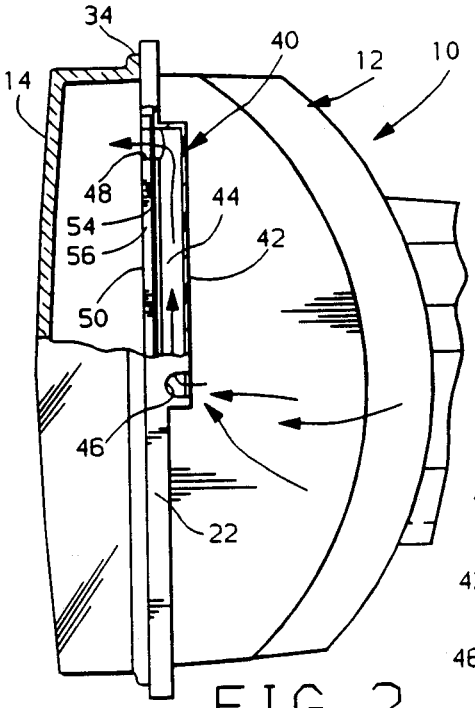
FIG. 2 is a side view of the headlamp of FIG. 1 taken on line 2—2 with certain parts broken away to show the details of construction of one of the vent devices for providing air into the interior of the headlamp.
Figure 5:
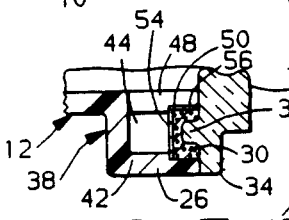
Figure 6:
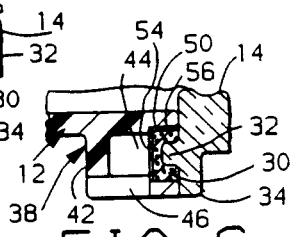

FIGS. 5 and 6 are cross-sectional views, taken respectively on lines 5—5 and 6—6 of FIG. 1, of the lower vent device which is part of the ventilation system according to the present invention.

Referring now to the drawings and more particularly FIG. 1 thereof, a replaceable bulb headlamp 10 is shown of the rectangular type comprising a reflector member 12 made of a plastic material and having the front face thereof closed by a glass or plastic lens 14. As is conventional, the reflector member includes a parabolic concave surface 16 which is aluminized so as to provide a reflecting surface which projects a forwardly directed beam of light provided by a replaceable bulb (not shown) positioned within a socket 18 located in the center of the reflector member 12.

More specifically, the front face of the reflector member 12 is defined by a pair of vertically orientated side portions 20 and 22 and a horizontally orientated top portion 24 and a bottom portion 26. A continuous channel 28 of uniform depth (except as explained hereinafter) is formed in the side, top, and bottom portions 20–26 of the reflector member 12 around the entire margin of the front face thereof. As is conventional, the lens 14 is sealingly joined to the front face of the reflector member 12 by an adhesive 30, such as butyl rubber, which can also serve as a sealant. In this regard, the adhesive 30 is located in the channel 28 and a complementary shaped projection 32 integrally formed on the flange 34 of the lens 14 is adapted to extend into the channel 28 and to be bonded to the front face of the reflector member 12 by means of the adhesive 30. In order to assure that the lens 14 is firmly retained by the reflector member 12, several clips (not shown) are provided along the top portion and bottom portion of the reflector member and serve to mechanically interconnect the flange 34 of the lens to the reflector member 12.

In order to vent the headlamp 10 so as to provide moisture from collecting in the interior thereof, a ventilating system is provided which as seen in FIG. 1 includes three air vent devices 36, 38, and 40 located respectively in the side portion 20, bottom portion 26, and side portion 22. Each of the air vent devices 36, 38 and 40 is essentially identical in construction and consequently the air vent device 40 shall be described in detail and the corresponding parts of the air vent devices 36 and 38 shall be identified by the same reference numerals. In this regard, it will be noted that the rear of the side portion 22 is formed with an integral enlargement or boss 42 located in vertical alignment with the associated portion of channel 28 of the side portion 22.

Figure 4:
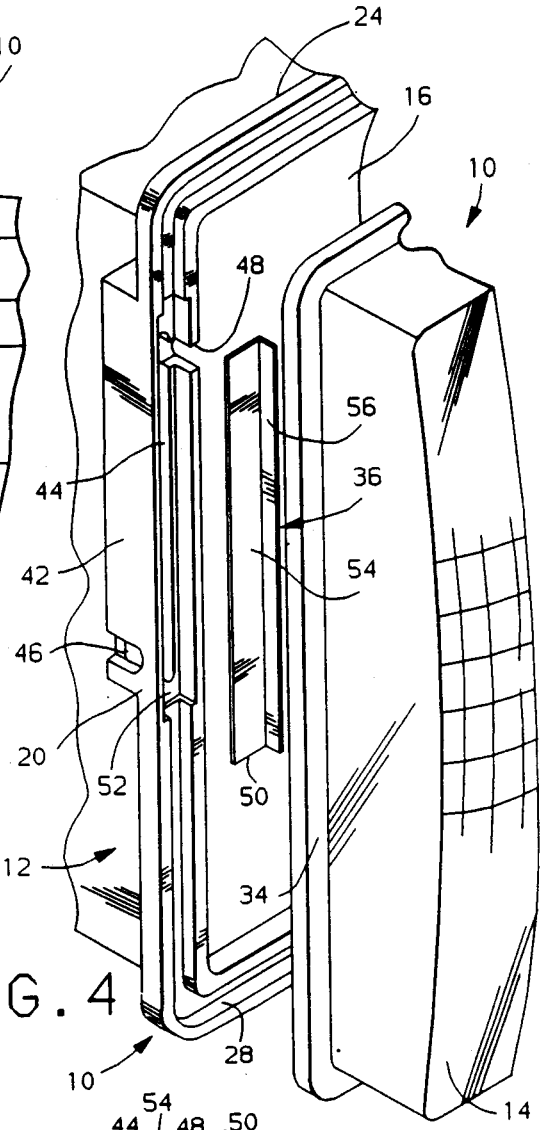
FIG. 4 is an exploded perspective view of the left side of the headlamp showing the elements in detail which form another of the vent devices used in the ventilation system for the headlamp of FIG. 1.
Figure 3:
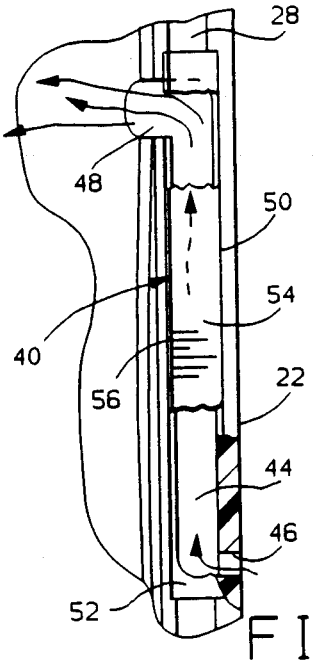
FIG. 3 is an enlarged frontal view of the vent device shown in FIG. 2 and as seen in the encircled area denoted by the numeral 3 in FIG. 1.

As best seen in FIG. 3, an elongated recess or well 44 is formed in the boss 42 with the opening of the well being located in the channel 28. The well 44 is approximately the same length as the boss 42 which is about one-half the vertical length of th side portion 22 and is connected by a port 46 adjacent the lower end of the well 44 to the atmosphere and by a port 48 adjacent the upper end of the well 44 to the interior of the headlamp 10. An elongated L-shaped plate 50 having the configuration of an angle iron is positioned on a ledge or support surface 52, as seen in FIGS. 3 and 4, which encircles the opening of the well 44. Thus, one leg 54 of the plate 50 covers the well 44 so as to form a passage within the boss 42 and the other leg 56 of the plate 50 serves to cover a portion of the port 48 so the adhesive 30 when applied does not flow into the interior of the headlamp 10. As seen in FIG. 1, the air vent devices 36, 38 and 40 to allow air to flow into the interior of the headlamp via the ports 46 and 48 of the air vent devices 36 and 40 and then flow out of the headlamp via the ports 48 and 46 of the air vent device 38. In each case, the length of the passage within the air vent device 36, 38 and 40 should be sufficiently long to keep dust and splash water from gaining access into the interior of the headlamp 10.

Various changes and modifications can be made in the above described ventilation system for a headlamp without departing from the spirit of the invention. Such changes and modifications are contemplated by the inventor and he does not wish to be limited except by the scope of the appended claims.

The embodiments of the invention in which an exclusive property or privilege is claimed are defined as follows:

1. A ventilation system for a replaceable bulb headlamp in which the headlamp comprises a rectangular reflector member, the front face of which is closed by a rectangular lens member, said lens member having an outer flange provided with a projection located within a channel formed around the entire margin of said front face of said reflector member, said channel having an adhesive therein for bonding said lens member to said reflector member, the improvement comprising a first elongated boss formed on said reflector member behind said channel along one side portion of said reflector member and a second elongated boss formed on said reflector member, an elongated well formed in each of said bosses with the opening of said well being located in said channel, a plate located in said channel and covering said opening of said well so as to form a passage within each of said bosses and preventing said adhesive from flowing into the interior of said headlamp, and port means formed in said reflector member at opposite ends of the passage of each of said bosses so as to allow air to flow into and out of said headlamp.

2. A ventilation system for a replaceable bulb headlamp in which the headlamp comprises a rectangular reflector member, the front face of which is closed by a rectangular lens member, said lens member having an outer flange provided with a projection located within a channel formed around the entire margin of said front face of said reflector member, said channel having an adhesive therein for bonding said lens member to said reflector member, the improvement comprising a first elongated boss formed on said reflector member behind said channel along one side portion of said reflector member and a second elongated boss formed on said reflector member behind said channel along the bottom portion of said reflector member, an elongated well formed in each of said bosses that opens into said channel, an L-shaped plate located in said channel and covering said opening of said well so as to form a passage within each of said bosses and preventing said adhesive from flowing into the interior of said headlamp, and port means formed at opposite ends of each of said bosses so that the passage provided therein allows air to flow into and out of said headlamp.

3. A ventilation system for a replaceable bulb headlamp in which the headlamp comprises a rectangular reflector member, the front face of which is closed by a rectangular lens member, said lens member having an outer flange provided with a projection located within a channel formed around the entire margin of said front face of said reflector member, said channel having an adhesive therein for bonding said lens member to said reflector member, the improvement comprising a first elongated boss formed on said reflector member behind said channel along each side portion of said reflector member and a third elongated boss formed on said reflector member behind said channel along the bottom portion of said reflector member, an elongated well formed in each of said bosses with the opening of said well being located in said channel, a ledge surrounding said opening, an L-shaped plate positioned on said ledge in said channel and covering said opening of said well so as to form a passage within each of said bosses and preventing said adhesive from flowing into the interior of said headlamp, and port means formed at opposite ends of each of said bosses so that the passage provided therein allows air to flow into and out of said headlamp.

4. A ventilation system for a replaceable bulb headlamp in which the headlamp comprises a rectangular reflector member having the front face thereof closed by a lens, said lens having an outer flange provided with a projection located within a channel formed around the entire margin of said front face of said reflector member, said channel having an adhesive therein for bonding said lens to said reflector member, and at least two air vent devices carried by said reflector member for providing cross flow ventilation for the interior of said headlamp, the improvement wherein at least one of said two air vent devices comprises a first elongated boss formed on said reflector behind said channel of said reflector member, an elongated well formed in said boss with the opening of said well being located in said channel, a plate located in said channel and covering said opening of said well so as to form a passage within said boss and prevent said adhesive from flowing into the interior of said headlamp, and port means formed in said reflector member at opposite ends of said passage so as to allow ventilation air to flow into and out of said headlamp.

* * * * *